US006363698B1

(12) United States Patent
Swain

(10) Patent No.: US 6,363,698 B1
(45) Date of Patent: Apr. 2, 2002

(54) SADDLE TREE

(75) Inventor: Barry Swain, West Midlands (GB)

(73) Assignee: Mondial Industries, Ltd., Hudson, OH (US)

( * ) Notice: Subject to any disclaimer, the term of this patent is extended or adjusted under 35 U.S.C. 154(b) by 0 days.

(21) Appl. No.: 09/561,051

(22) Filed: Apr. 28, 2000

(51) Int. Cl.[7] ..... B68C 1/02; B68C 1/08
(52) U.S. Cl. ..... 54/44.5; 54/44.1
(58) Field of Search ..... 54/44.1, 44.4, 54/44.5, 44.7, 65

(56) References Cited

U.S. PATENT DOCUMENTS

| | | | | | |
|---|---|---|---|---|---|
| 270,270 | A | * | 1/1883 | Wilbourn | 54/44.1 |
| 821,135 | A | * | 5/1906 | Szameitat | 54/44.1 |
| 1,111,817 | A | * | 9/1914 | Adams | 54/44.4 |
| 1,213,329 | A | * | 1/1917 | Beal | 54/44.1 |
| 2,353,622 | A | * | 7/1944 | Boyle | 54/44.1 |
| 3,835,621 | A | | 9/1974 | Gorenschek | 54/44 |
| 5,435,116 | A | | 7/1995 | Brown | 54/44.5 |
| 5,517,808 | A | * | 5/1996 | Schleese | 54/44.1 |

FOREIGN PATENT DOCUMENTS

| | | |
|---|---|---|
| EP | 0744376 | 11/1996 |

* cited by examiner

*Primary Examiner*—Peter M. Poon
*Assistant Examiner*—Elizabeth Shaw
(74) *Attorney, Agent, or Firm*—Reinhart Boerner Van Deuren s.c.

(57) ABSTRACT

A saddle tree has a rigid pommel portion and a rigid cantle portion joined by at least one discrete flexible connector whereby the tree is able to flex centrally of the tree.

29 Claims, 4 Drawing Sheets

SADDLE TREE

RELATED APPLICATIONS

None.

STATEMENT REGARDING FEDERALLY SPONSORED RESEARCH OR DEVELOPMENT

Not applicable.

TECHNICAL FIELD OF THE INVENTION

The present invention relates to a saddle tree and a saddle incorporating a saddle tree.

BACKGROUND OF THE INVENTION

A saddle for a horse, pony, etc. is typically constructed using a saddle tree, which provides the framework on which a seat unit is mounted and which also provides the main structural strength of the saddle. Conventionally, saddle trees have been made entirely of wood or of wood and metal such as steel or iron.

It has long been known that it is desirable for the saddle tree to be able to flex in order to accommodate movement of the horse, and particularly the horse's spine, during riding. In the past, this has been achieved for example by careful and selective sawing of the wooden saddle tree. However, this is a skill which requires great experience and is difficult to reproduce exactly. It is also possible to damage a saddle tree during sawing. Alternative ways of providing a flexible saddle tree have therefore been sought.

For example, in U.S. Pat. No. 5435116, there is disclosed a saddle tree of synthetic resin. The saddle tree has a seat unit which has a thin central portion where the tree can flex. Side skirts attached to the seat unit are also arranged to flex during movement. It has been found, however, that this type of prior art saddle tree does not always have the required rigidity in all areas and, moreover, is not particularly suitable for an English type saddle.

Accordingly, it is an object of the present invention to provide a saddle tree that can flex and is also suitable for use in construction of an English type saddle in particular.

SUMMARY OF THE INVENTION

According to the present invention, there is provided a saddle tree, the saddle tree comprising a rigid pommel portion and a rigid cantle portion joined by at least one discrete flexible connector whereby the tree is able to flex centrally of the tree.

The saddle tree of the present invention is relatively simple to manufacture and can flex to conform to movement of the horse during riding and yet which has the required rigidity in the pommel and cantle areas. The risk of injury to the horse, and particularly to the horse's spine, is much reduced with a saddle tree according to the present invention.

Preferably, there are two connectors joining the pommel and cantle portions, a connector being positioned on each side of the tree.

At least one tie bar may be provided between the pommel and cantle portions.

The connector or connectors may be composed of polypropylene. Other suitable materials include nylon and carbon fibre. Carbon fibre reinforcing may be used.

Alternatively, the connector or connectors may be composed of separate components which are resiliently hinged together.

The pommel and cantle portions may be composed of wood.

In a preferred embodiment, the cantle portion has an inverted U-shape having depending legs, and the pommel portion has an inverted U-shape having depending legs which terminate in free ends and each of which has a projecting arm that faces backwards towards the cantle portion, there being a discrete flexible connector joining each of the depending legs of the cantle portion to a respective one of the projecting arms of the pommel portion.

The present invention also includes a saddle including a saddle tree as described above.

BRIEF DESCRIPTION OF THE DRAWINGS

An embodiment of the present invention will now be described by way of example with reference to the accompanying drawings, in which.

Figure 1:
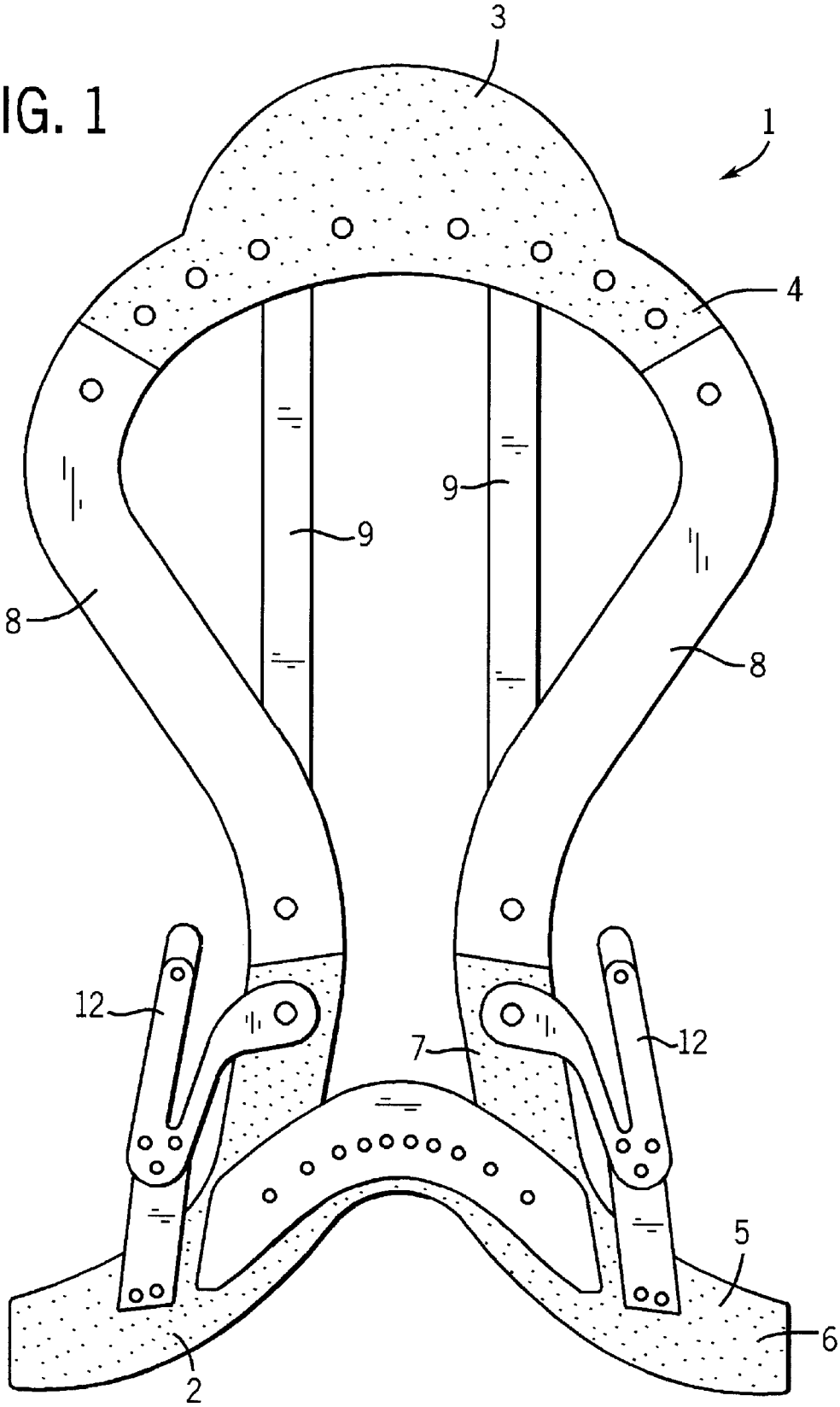
FIG. 1 is a view from above of an example of a saddle tree according to the present invention.
Figure 2:
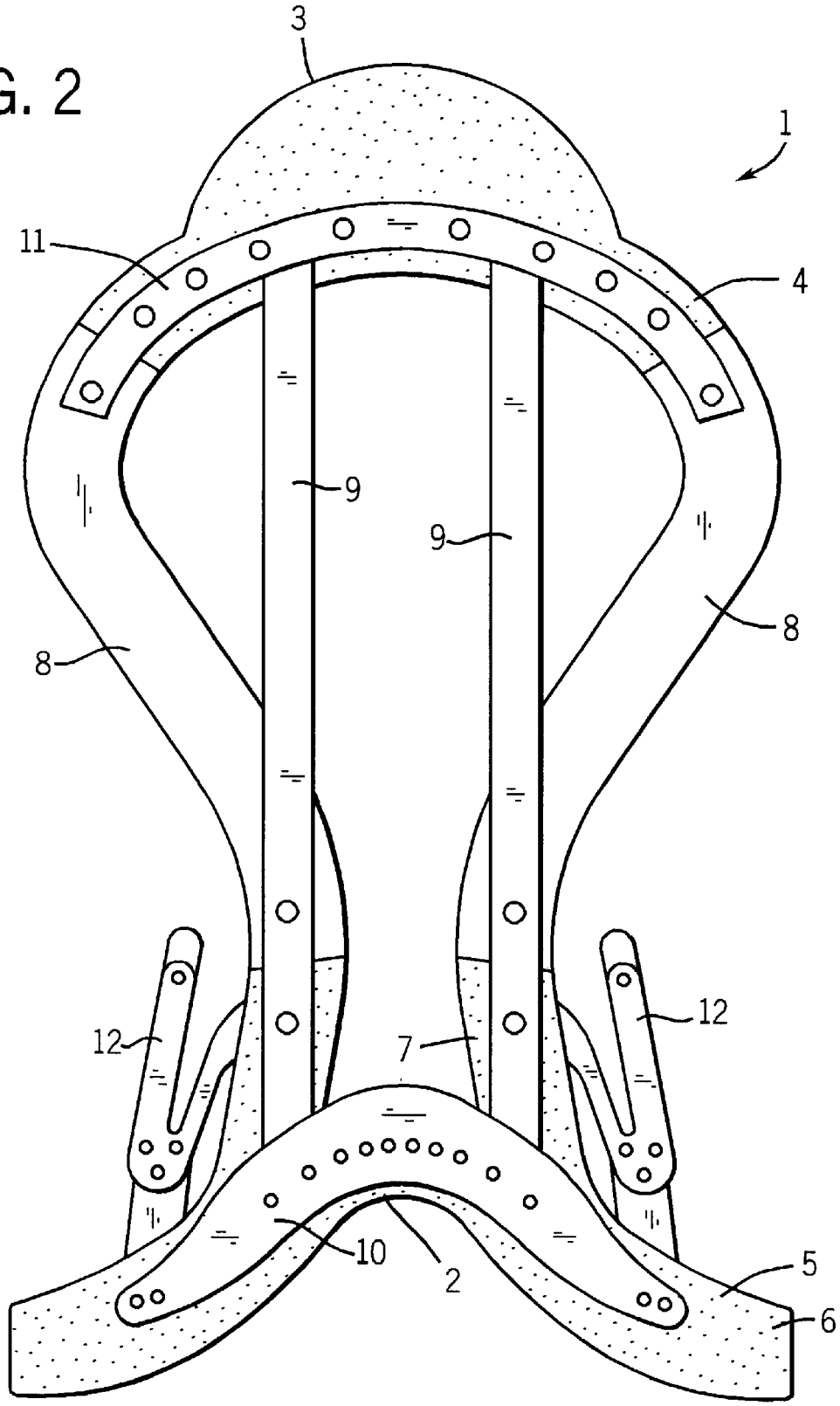
FIG. 2 is a view from below of the saddle tree of FIG. 1.

Referring to the drawings, a saddle tree 1 has a pommel portion 2 (situated in use towards the front of the horse) and a cantle portion 3 (situated in use towards the rear of the horse). The cantle portion 3 is wooden and is generally in the shape of an inverted U having depending legs 4. The pommel portion 2 is also made of wood and generally in the shape of an inverted U having depending legs 5 which terminate in free ends 6. Each of the legs 5 of the pommel portion 2 carries a projecting arm 7 which projects back toward the cantle portion 3.

Each of the legs 4 of the cantle portion 3 is joined to a respective one of the arms 7 of the pommel portion 2 by a flexible connector 8. The connectors 8 can be joined to the pommel portion 2 and cantle portion 3 by any suitable means such as by adhesive and/or bolts and/or rivets. The connectors 8 have a lazy S-shape in order to follow the contours of the horse's back. In one example, the connectors 8 are made from polypropylene. Other flexible materials such as nylon, other polymers, carbon fibre, leather, rubber, etc may be used. Such materials may include carbon fibre reinforcing, for example.

The saddle tree 1 also includes a pair of steel tie bars 9 which are connected between the pommel portion 2 and cantle portion 3 to maintain the integrity, resilience and stiffness of the saddle tree 1. Reinforcing steel plates 10,11 may be riveted to the pommel portion 2 and cantle portion 3. The reinforcing plates 10,11 may be used to secure the connectors 8 and the tie bars 9 to the pommel portion 2 and cantle portion 3.

Steel stirrup bars 12 are riveted to the pommel portion 2 on each side of the saddle tree 1 as is conventional.

Figure 3:
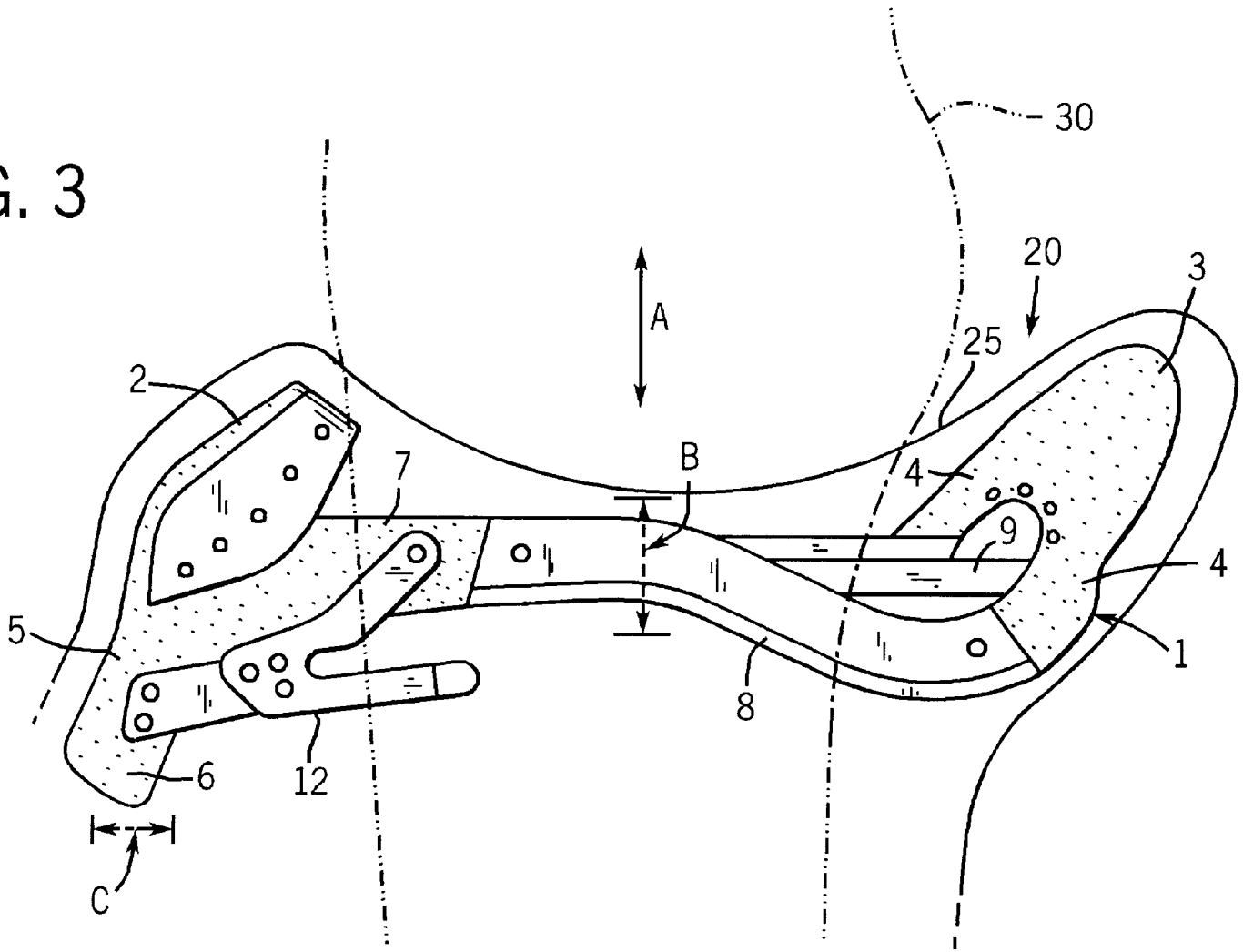
FIG. 3 is a partially sectioned side elevation of a saddle incorporating the saddle tree of FIGS. 1 and 2; and, FIG. 4 is an exploded perspective view of the saddle of FIG. 3.
Figure 4:
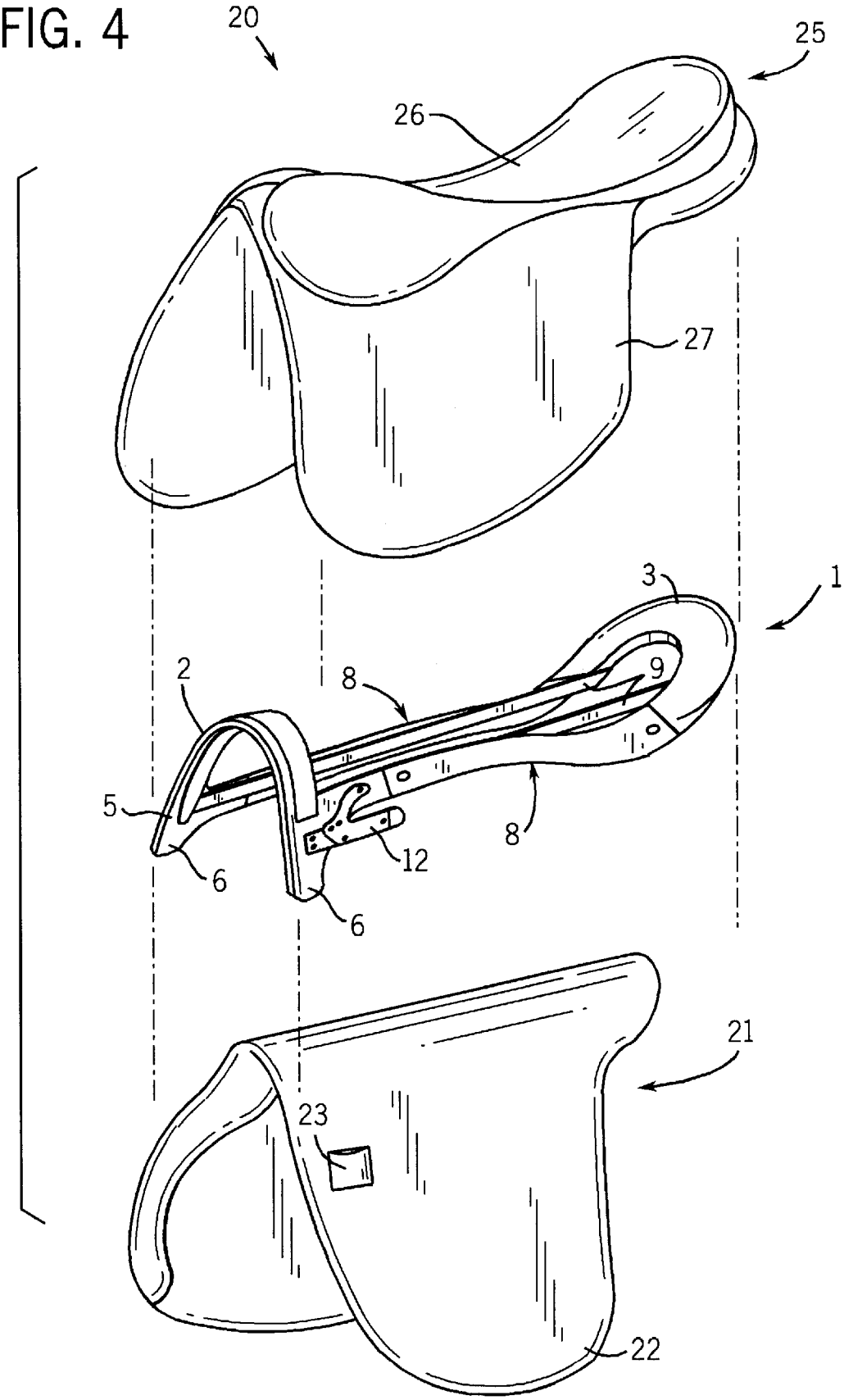

As shown particularly in FIGS. 3 and 4, an English type saddle 20 is built up using the saddle tree 1. In particular, an undersaddle or "panel" 21 is made of leather and has downwards hanging cushioned flaps 22 which lie over the horse's side in use. Each flap 22 has an external pocket 23 which receives the free end 6 of the depending leg 5 on each side of the pommel portion 2 when the saddle tree 1 is placed on the panel 21. A leather seat unit 25 having a sculpted seat 26 and downwards hanging flaps 27 is positioned over the saddle tree 1.

During riding, the horse's spine flexes up and down in the central region of the horse's back. This is mirrored by the movement A of the rider 30 (shown in dashed lines). The movement of the horse and rider 30 up and down causes the connectors 8 to flex vertically up and down generally centrally of the tree 1 as indicated at B. During flexion of the connectors 8, the free ends 6 of the arms 5 of the pommel portion 2 move back and forth as indicated at C. Accordingly, the connectors 8 allow the saddle tree 1 to flex at its centre in a vertical direction, thereby allowing the saddle 20 as a whole to conform more closely to the shape of the horse and particularly the horse's back. The connectors 8 also cause the free ends 6 of the pommel portion 2 to move back and forth in a cyclic motion. This means that any pressure applied by the free ends 6 of the pommel portion 2 is relieved in a cyclical fashion. It is known that conventional saddles can apply high pressure to a horse's shoulders which can restrict blood flow through that region, especially if the saddle is a poor fit and is girthed up tight. Such pressure is relieved with the saddle tree 1 of the present invention by the cyclical motion of the free ends 6 of the pommel portion 2.

An embodiment of the present invention has been described with particular reference to the example illustrated. However, it will be appreciated that variations and modifications may be made to the example described within the scope of the present invention. For example, whilst the saddle tree 1 has been described primarily in the construction of an English type saddle, other saddles such as Western or racing saddles may be constructed using the saddle tree 1 of the present invention. The whole saddle tree 1 could be formed as a unitary piece of a suitable synthetic material which is rigid in the pommel and cantle portions and flexible in the connectors.

What is claimed is:

1. A saddle tree, comprising:

a substantially rigid cantle portion having an inverted U-shape with depending cantle legs;

a substantially rigid pommel portion having an inverted U-shape with depending pommel legs that terminate in free ends, each of said pommel legs including a projecting arm that projects toward the cantle portion; and a discrete flexible connector joining each depending cantle leg to a respective projecting arm of the pommel portion, whereby the tree is able to flex centrally of the tree.

2. A saddle tree according to claim 1, further comprising at least one tie bar between the pommel and cantle portions.

3. A saddle tree according to claim 1 wherein the connector is composed of polypropylene.

4. A saddle tree according to claim 1 wherein the connector is composed of nylon.

5. A saddle tree according to claim 1 wherein the connector includes carbon fibre.

6. A saddle tree according to claim 1 wherein the pommel and cantle portions are composed of wood.

7. A saddle tree according to claim 1 wherein the connector is composed of a composite comprising a synthetic polymer and carbon fiber.

8. A saddle, comprising:

a saddle tree comprising a rigid cantle portion having an inverted U-shape which has depending cantle legs, the saddle tree further comprising a rigid pommel portion having an inverted U-shape which has depending pommel legs that terminate in free ends, said pommel legs each including a projecting arm that projects toward the cantle portion, wherein a discrete flexible connector joins each depending cantle leg to a respective projecting arm of the pommel portion whereby said tree is able to flex;

an undersaddle having external pockets that engage said pommel portion; and a seat unit received on said saddle tree.

9. A saddle tree according to claim 8, further comprising at least one tie bar between the pommel and cantle portions.

10. A saddle tree according to claim 8 wherein the connector is composed of polypropylene.

11. A saddle tree according to claim 8 wherein the connector is composed of nylon.

12. A saddle tree according to claim 8 wherein the connector includes carbon fibre.

13. A saddle tree according to claim 8 wherein the pommel and cantle portions are composed of wood.

14. A saddle tree according to claim 8 wherein the connector is composed of a composite comprising a synthetic polymer and carbon fiber.

15. A saddle tree, comprising:

a substantially rigid cantle portion having depending first and second cantle legs on opposite sides thereof;

a substantially rigid pommel portion having depending first and second pommel legs that terminate in free ends on opposite sides thereof;

a first discrete flexible connector extending between the first cantle leg and the pommel at a location on the pommel which is intermediate a central location on the pommel and the free end of the first pommel leg; and a second discrete flexible connector extending between the second cantle leg and the pommel at a location on the pommel which is intermediate the central location on the pommel and the free end of the second pommel leg, whereby the tree is able to flex centrally of the tree in an essentially vertical direction.

16. A saddle tree according to claim 15 wherein the first and second discrete flexible connectors are formed in a "lazy S" shape to follow the contours of the back of a horse.

17. A saddle tree according to claim 15, further comprising a first tie bar between the pommel portion and the cantle portion.

18. A saddle tree according to claim 17, further comprising a second tie bar between the pommel portion and the cantle portion, the first and second tie bars being disposed on opposite sides of the saddle tree at spaced-apart locations.

19. A saddle tree according to claim 17 wherein the first and second tie bars are composed of steel.

20. A saddle tree according to claim 15 wherein the first and second discrete flexible connectors are composed of polypropylene.

21. A saddle tree according to claim 15 wherein the first and second discrete flexible connectors are composed of nylon.

22. A saddle tree according to claim 15 wherein first and second discrete flexible connectors include carbon fibre.

23. A saddle tree according to claim 15 wherein the first and second discrete flexible connectors are composed of a composite comprising a synthetic polymer and carbon fiber.

24. A saddle tree according to claim 15 wherein the pommel portion and the cantle portion are composed of wood.

25. A saddle tree according to claim 15 additionally comprising:

a first metal reinforcing plate located under the cantle; and a second metal reinforcing plate located under the pommel.

26. A saddle tree according to claim 25 additionally comprising a metal gullet plate located on top of the pommel.

27. A saddle tree according to claim 15 additionally comprising a steel stirrup bar mounted on each of the first and second pommel legs.

28. A saddle tree according to claim 15, wherein the cantle, the pommel, and the first and second discrete flexible connectors are formed as a unitary piece.

29. A saddle tree according to claim 28, wherein the cantle, the pommel, and the first and second discrete flexible connectors are formed of a suitable synthetic material.

* * * * *

UNITED STATES PATENT AND TRADEMARK OFFICE

CERTIFICATE OF CORRECTION

PATENT NO. : 6,363,698 B1
DATED : April 2, 2002
INVENTOR(S) : Barry Swain

It is certified that error appears in the above-identified patent and that said Letters Patent is hereby corrected as shown below:

Title page,
Item [75], Inventor Name: -- Barrie P. Swain --

Signed and Sealed this

Third day of September, 2002

*Attest:*

*Attesting Officer*

JAMES E. ROGAN
*Director of the United States Patent and Trademark Office*